United States Patent [19]

Ishizuka et al.

[11] 4,253,809

[45] Mar. 3, 1981

[54] VANE COMPRESSOR WITH ROTOR HAVING METALLIC BASE AND VANE SLOTS AND A PERIPHERY OF LOWER SPECIFIC GRAVITY

[75] Inventors: Yutaka Ishizuka; Shinichi Kobayashi, both of Higashi-Matsuyama, Japan

[73] Assignee: Diesel Kiki Co., Ltd., Tokyo, Japan

[21] Appl. No.: 32,517

[22] Filed: Apr. 23, 1979

[30] Foreign Application Priority Data

May 22, 1978 [JP] Japan ..... 53-68933

[51] Int. Cl.[3] ..... F01C 21/08; F04C 29/00

[52] U.S. Cl. ..... 418/152; 418/178; 418/179

[58] Field of Search ..... 418/152, 153, 178, 179

[56] References Cited

U.S. PATENT DOCUMENTS

| | | | |
|---|---|---|---|
| 2,903,971 | 9/1959 | Collins | 418/152 |
| 3,335,944 | 8/1967 | Conde et al. | 418/152 |
| 3,489,125 | 1/1970 | Fend | 418/179 |

FOREIGN PATENT DOCUMENTS

| | | | |
|---|---|---|---|
| 278382 | 12/1927 | United Kingdom | 418/179 |
| 308394 | 3/1929 | United Kingdom | 418/152 |

*Primary Examiner*—John J. Vrablik

*Attorney, Agent, or Firm*—Frishauf, Holtz, Goodman & Woodward

[57] ABSTRACT

An improved vane compressor is provided which employs a rotor comprising: a hollow boss element into which a rotary shaft is force fitted; at least two pairs of lateral plates formed upright on a peripheral surface of said boss element; and a peripheral element fitted between opposed ones of the lateral plates of adjacent pairs; wherein said boss element and said lateral plates are made of a metal having a sufficient mechanical strength, and said peripheral element is made of a material which has a smaller specific gravity than that of said metal and has a coefficient of friction small enough to keep sliding contact faces of parts facing said rotor in the pump section of the compressor from undergoing substantial abrasion.

12 Claims, 4 Drawing Figures

VANE COMPRESSOR WITH ROTOR HAVING METALLIC BASE AND VANE SLOTS AND A PERIPHERY OF LOWER SPECIFIC GRAVITY

FIELD OF THE INVENTION

The present invention relates to a compressor, and more particularly to a vane compressor for compressing a refrigerant circulating in an air conditioner for vehicles.

A vane compressor for use in an air conditioner for vehicles is already known, e.g. from U.S. Pat. No. 3,834,846 issued Sept. 10, 1974, which is of the type including a rotary shaft arranged to be rotated by an associated prime mover; a rotor secured to said rotary shaft for rotation in unison therewith, the rotor having a plurality of slits formed in an outer peripheral surface thereof; a plurality of vanes radially movably inserted in said slits; and a housing accommodating said rotor and said vanes, the rotor, the vanes and the housing cooperating to define pump working chambers between them, wherein a refrigerant pumping action is carried out by the rotation of said rotor.

However, conventionally the rotor employed in such vane compressor is made of cast iron and is thus heavy in weight, so that a considerable part of the energy supplied by an associated prime mover is consumed in driving the rotor. Furthermore, there occurs a large friction bewteen the end faces of the rotor and the associated faces of the front and rear blocks disposed in contact therewith, which may cause seizure of these faces.

OBJECTS AND SUMMARY OF THE INVENTION

It is therefore an object of the invention to provide a vane compressor which includes a rotor which is light in weight and has highly lubricious surfaces to reduce the friction between the rotor and its adjacent parts arranged in contact therewith, thus leading to a reduction in the energy to be consumed in driving the rotor, as well as prevention of seizure of the engaging surfaces of these parts which may be produced due to the frictional contact between these surfaces.

According to the present invention, there is provided an improved vane compressor of the type having a pump housing, a rotor disposed within said pump housing for rotation by means of a rotary shaft, and a plurality of vanes provided in a peripheral wall of said rotor, wherein rotation of said rotor causes said pump housing, rotor and adjacent ones of said vanes to define therebetween pump working chambers changing in volume for carrying out suction and delivery of liquid, wherein the improvement is characterized by that said rotor comprises: a boss element having a central axial bore into which said rotary shaft is force fitted; at least two pairs of lateral plates formed on a peripheral lateral surface of said boss element at circumferentially equal intervals and radially outwardly projecting, the lateral plates of each pair being spaced from each other to define a slit therebetween for receiving one of said vanes therein; and a peripheral element with an arcuate outer peripheral surface, provided between opposed ones of the lateral plates of adjacent pairs, wherein said boss element and said lateral plates are made of a metal having a sufficient mechanical strength, and said peripheral element is made of a material which has a smaller specific gravity than that of said metal and has a coefficient of friction small enough to keep sliding contact faces of parts facing said rotor in the pump housing from undergoing substantial abrasion.

Other objects, features and advantages of the invention will appear more fully from the ensuing description.

DETAILED DESCRIPTION OF THE INVENTION

Figure 1:
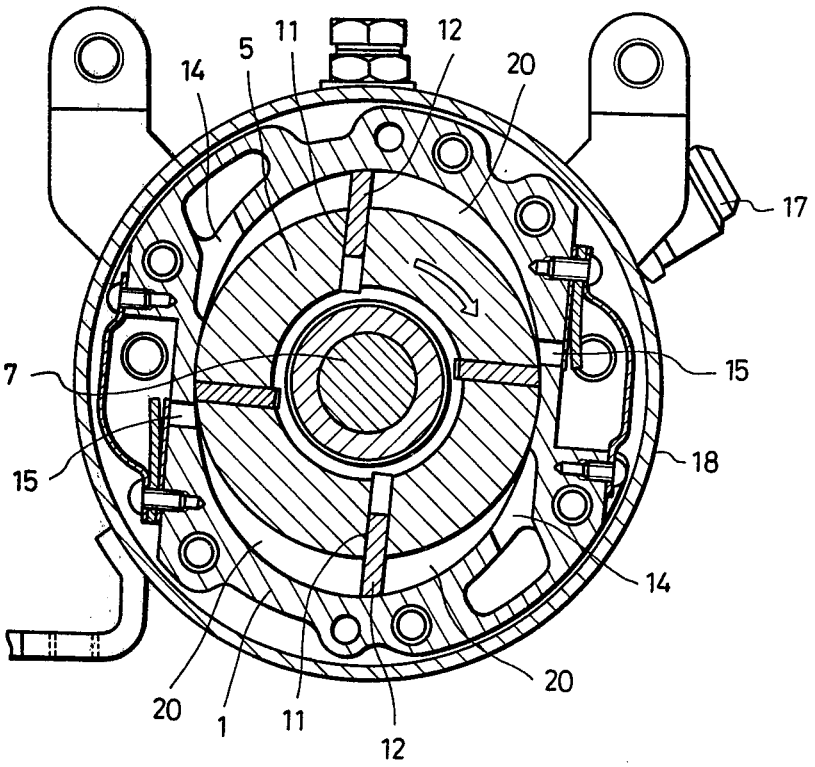
FIG. 1 PRIOR ART
FIG. 1 is a transverse sectional view of a conventional vane compressor.
Figure 2:
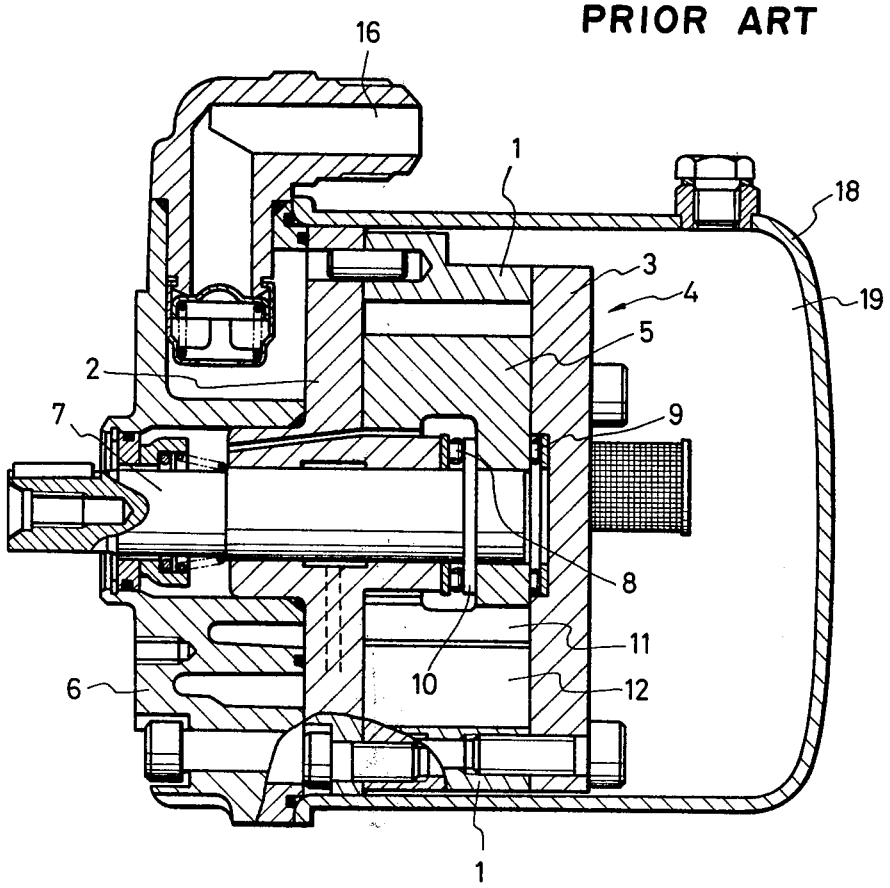
FIG. 2 PRIOR ART
FIG. 2 is a longitudinal sectional view of the compressor of FIG. 1.

A conventional type vane compressor is illustrated in FIGS. 1 and 2. A cam ring 1 of an oblong cross section is combined at opposite ends thereof with front and rear blocks 2, 3 secured thereto so that these elements form a pump housing 4. A rotor 5 of a circular cross section is rotatably disposed within said housing 4. Said rotor 5 is fitted on and secured to a rotary shaft 7 which penetrates a front head 6 secured to an front end face of the front block 2 and said front block 2. The rotary shaft 7 is rotatably supported by the front block 2. A thrust bearing 8 is interposed between the rotor 5 and the front block 2 via a collar 10 radially projecting from the rotary shaft 7, and another thrust bearing 9 between the rotor 5 and the rear block 3, respectively, to support axial forces or thrust loads caused by the rotor 5 and maintain the clearances between the rotor 5 and the two blocks 2, 3 at respective prescribed values. The rotor 5 has its peripheral lateral surface formed with a plurality of axial slits 11 radially opening therein and are circumferentially spaced from each other at equal intervals, in which a plurality of plate like vanes 12 are radially movably fitted.

As illustrated in FIG. 1, the cam ring 1 is formed with refrigerant inlets 14 and outlets 15 opening in an inner peripheral surface thereof and communicating with the refrigerant suction port 16 and the refrigerant delivery port 17 of the compressor, respectively. A cover 18 is mounted on the front head 6 in a fashion enclosing the pump housing 4 so as to define a refrigerant delivery chamber 19 between the cover 6 and the pump housing 4. Said outlets 15 communicate with said delivery port 17 via this chamber 19.

With this arrangement, when the rotor 5 is rotated by the rotation of the rotary shaft 7 which is connected to the drive shaft of a prime mover, not illustrated, the vanes 12 carried by the rotor 5 are pushed radially outwardly due to a centrifugal force produced by the rotation of the rotor 5 to slide on the inner peripheral surface of the cam ring 1 in a manner being pressed against it.

Each time when one of the vanes 12 passes each of the inlets 14 formed in the wall of the cam ring 1, a pump working chamber 20 is formed between said vane, the next or immediately following vane and the rotor for aspirating refrigerant. Said chamber 20 increases in volume from its smallest value to its largest value during its suction stroke to aspirate refrigerant, whereas it decreases in volume from its largest value to its smallest value during its delivery stroke so that the refrigerant is pressurized to be discharged through the outlet 15. Such cyclic action is repeated, thus to carry out a pumping operation.

However, the rotor 5 of the above-described compressor which is made of cast iron and is accordingly heavy in weight as previously noted, consumes a great amount of energy during its rotation.

Also, the clearances between the pump component parts in the thrust-acting direction, that is, the clearances between the two blocks 2, 3 and the rotor 5 should be adjusted so as to be each 1/200 mm at the maximum. To satisfy such small clearances, the thrust bearings 8, 9 have to be manufactured with high accuracy in size, and also the thrust bearing supporting surfaces of the front and rear blocks 2, 3 and the rotor 5 should be machined with high precision. Furthermore, mounting of the thrust bearings 8, 9 must be carried out with much care. Maladjustment of the clearances between these parts in the thrust-acting direction and abrasion in the component parts of the thrust bearings 8, 9 may bring about a large friction between the rotor 5 and the front and rear blocks 2, 3, thus often causing the phenomenon that the sliding contact surfaces of these parts cohere to each other or seize through excessive temperature.

Figure 3:
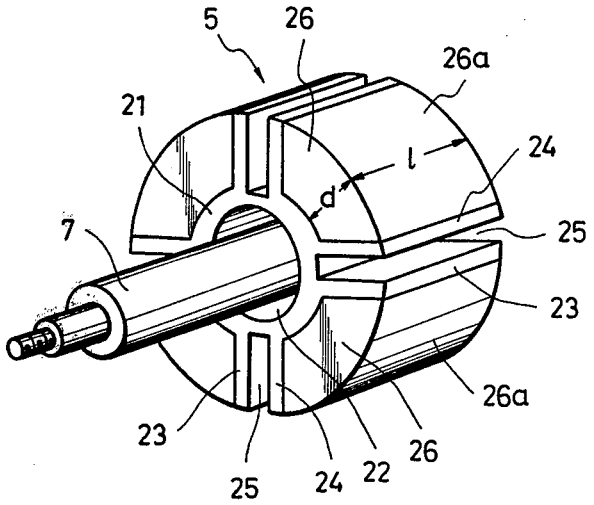
FIG. 3 is a perspective view of an example of the rotor used in the vane compressor according to the invention.
Figure 4:
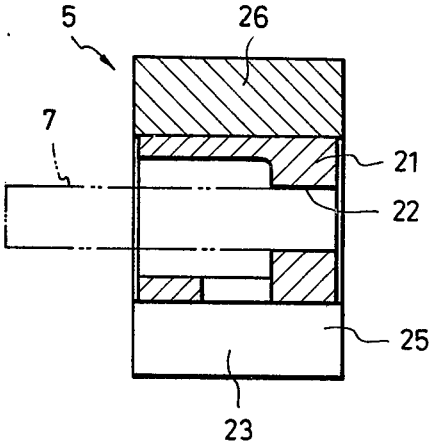
FIG. 4 is a longitudinal sectional view of the rotor of FIG. 3.

An embodiment of the rotor 5 proposed by the present invention will now be described with reference to FIGS. 3 and 4. The rotor 5 has a boss element 21 which has a through bore 22 extending along the axis thereof, into which a rotary shaft 7 is to be force fitted. The boss element 21 has a peripheral lateral surface thereof formed integral with at least two pairs of lateral plates 23, 24 which are circumferentially spaced from each other at equal intervals and extend radially outwardly. The lateral plates 23, 24 of each pair are spaced from each other by a prescribed distance to define a slit 25 for receiving a vane.

The boss element 21 and the lateral plates 23, 24 are made of a metal having a sufficiently high mechanical strength, for instance steel or cast iron, to ensure a strength necessary for holding the vane in the slit 25 and also for fixed engagement of the boss element 21 with the rotary shaft 7.

The lateral plates 23 and 24 of the adjacent pairs define a space of a sectorial cross section, into which a peripheral element 26 of a correspondingly sectorial cross section is rigidly fitted. This peripheral element 26 is made of a highly lubricious and lightweight material. As this highly lubricious and lightweight material, synthetic resin such as fluorine-contained polymers, particularly tetrafluoroethylene, aluminum and alloys thereof may be preferably used.

The peripheral element 26 has its outer peripheral surface formed as an arcuate surface 26*a* extending circumferentially of the boss element 21 at a constant distance from the center thereof. The diameter d of the peripheral portion 26 is so predetermined that said outer peripheral surface of the element 26 radially outwardly projects from the tip surfaces of the paired lateral plates 23, 24 by a very slight amount which is substantially inappreciable. Also, the length l of the peripheral element 26 is so predetermined that the opposite end faces of the element 26 projects from the opposite end faces of the lateral plates 23, 24, axially of the rotor, by a very slight or inappreciable amount. More specifically, the differences between the projecting faces of the peripheral element 26 and the associated end faces of the boss portion 21, the lateral plates 23, 24 are approximately from 2 mm to 1/200 mm in the radial direction and approximately from 2 mm to 1/200 mm in the axial direction in the case of a peripheral element 26 with a diameter of 7 cm and a length of 5 cm.

As is clear from FIG. 1, the rotor 5 and the cam ring 1 are held in contact with each other at two points. By constructing the rotor 5 as mentioned above, only the outer peripheral surface 26*a* of the peripheral element 26 can be held in contact with the inner peripheral wall of the cam ring 1. Further, if the thrust bearings 8, 9 become so abraded or worn that the pump component parts become degraded in dimensional accuracy in the thrust-acting direction, the rotor 5 has either of the end faces brought into direct contact with the associated face of the front block 2 or the rear block 3. However, according to the above-described construction of the rotor 5 of the present invention, only the peripheral element 2*b* can have either of its end faces brought into contact with the associated face of the block. Thus, the friction between the rotor 5 and the cam ring 1 and between the rotor 5 and the front and rear blocks 2,3 can be kept at a low value, so that the seizure of the sliding contact faces of these parts can be avoided.

In the compressor according to the illustrated embodiment, the rotor carries four vanes. However, the number of the vanes is not limited to four but may be optionally selected insofar as it is plural. If a different number is selected, the number of the pairs of lateral plates defining slits therebetween for receiving the vanes should of course be the same as the number of the vanes.

It is to be understood that the foregoing description relates to preferred embodiments of the invention and that various changes and modifications may be made in the invention without departing from the spirit and scope thereof.

What is claimed is:

1. A rotor for use in a pump section of a vane compressor, comprising:

a boss element having a central axial bore into which a rotary shaft is force fitted;

at least two pairs of lateral plates formed on a peripheral lateral surface of said boss element at circumferentially equal intervals and outwardly projecting therefrom, said lateral plates being integrally formed with said boss element, the lateral plates of each pair being spaced from each other to define a slit therebetween for receiving one of said vanes therein;

said boss element and said lateral plates extending throughout the substantially entire axial length of said rotor; and a plurality of peripheral elements, each having an arcuate outer peripheral surface, said peripheral elements each being provided between opposed ones of the lateral plates of adjacent pairs, said peripheral elements each having an inner peripheral surface and opposite side surfaces disposed in contact with said peripheral lateral surface of said boss element and said opposed ones of the lateral plates of adjacent pairs, respectively;

said boss elements and said lateral plates being made of a metal having a sufficient mechanical strength;

said peripheral elements being made of a lubricious material which has a smaller specific gravity than that of said metal from which said boss elements and lateral plates are made, said material from which said peripheral elements are made also having a coefficient of friction small enough to keep sliding contact faces of parts facing said rotor in the pump housing from undergoing substantial abrasion; and said peripheral elements each having opposite end faces slightly projecting axially outwardly from the associated end faces of said boss element and having said arcuate outer peripheral surface thereof slightly projecting radially outwardly from radially outer surfaces of said lateral plates.

2. The rotor as recited in claim 1, in which said peripheral elements are made of aluminum.

3. The rotor as recited in claim 1, in which said peripheral elements are made of a synthetic resin.

4. The rotor as recited in claim 3, in which said synthetic resin is tetrafluoroethylene.

5. The rotor as recited in claim 1 or claim 3, in which said boss elements and said lateral plates are made of steel.

6. The rotor as recited in claim 1 or claim 3, in which said boss elements and said lateral plates are made of cast iron.

7. In a vane compressor of the type having a pump housing, a rotor disposed within said pump housing for rotation by means of a rotary shaft, and a plurality of vanes provided in a peripheral wall of said rotor, the rotation of said rotor causing said pump housing, rotor and adjacent ones of said vanes to define therebetween pump working chambers changing in volume for carrying out suction and delivery of liquid, the improvement wherein said rotor comprises:

a boss element having a central axial bore into which said rotary shaft is force fitted;

at least two pairs of lateral plates formed on a peripheral lateral surface of said boss element at circumferentially equal intervals and outwardly projecting therefrom, said lateral plates being integrally formed with said boss element, the lateral plates of each pair being spaced from each other to define a slit therebetween for receiving one of said vanes therein;

said boss element and said lateral plates extending throughout the substantially entire axial length of said rotor; and a plurality of peripheral elements, each having an arcuate outer peripheral surface, said peripheral elements each being provided between opposed ones of the lateral plates of adjacent pairs, said peripheral elements each having an inner peripheral surface and opposite side surfaces disposed in contact with said peripheral lateral surface of said boss element and said opposed ones of the lateral plates of adjacent pairs, respectively;

said boss elements and said lateral plates being made of a metal having a sufficient mechanical strength;

said peripheral elements being made of a lubricious material which has a smaller specific gravity than that of said metal from which said boss elements and lateral plates are made, said material from which said peripheral elements are made also having a coefficient of friction small enough to keep sliding contact faces of parts facing said rotor in the pump housing from undergoing substantial abrasion; and said peripheral elements each having opposite end faces slightly projecting axially outwardly from the associated end faces of said boss element and having said arcuate outer peripheral surface thereof slightly projecting radially outwardly from radially outer surfaces of said lateral plates.

8. The vane compressor as recited in claim 7, in which said peripheral elements are made of aluminum.

9. The vane compressor as recited in claim 7, in which said peripheral elements are made of a synthetic resin.

10. The vane compressor as recited in claim 9, in which said synthetic resin is tetrafluoroethylene.

11. The vane compressor as recited in claim 7 or claim 9, in which said boss elements and said lateral plates are made of steel.

12. The vane compressor as recited in claim 7 or claim 9, in which said boss elements and said lateral plates are made of cast iron.

* * * * *

UNITED STATES PATENT AND TRADEMARK OFFICE

CERTIFICATE OF CORRECTION

PATENT NO. : 4,253,809

DATED : March 3, 1981

INVENTOR(S) : Yutaka ISHIZUKA et al

It is certified that error appears in the above—identified patent and that said Letters Patent is hereby corrected as shown below:

Page 1 of the printed patent, change the title to:

--VANE COMPRESSOR WITH ROTOR HAVING METALLIC BOSS AND VANE SLOTS AND A PERIPHERY OF LOWER SPECIFIC GRAVITY--.

Signed and Sealed this

*Fifth* Day of *May 1981*

[SEAL]

*Attest:*

RENE D. TEGTMEYER

*Attesting Officer* *Acting Commissioner of Patents and Trademarks*